United States Patent [19]

Sundman

[11] Patent Number: 4,459,907

[45] Date of Patent: Jul. 17, 1984

[54] PRESS FOR REMOVING WATER

[75] Inventor: Frey V. Sundman, Karhula, Finland

[73] Assignee: A. Ahlstrom Osakeyhtio, Noormarkku, Finland

[21] Appl. No.: 412,768

[22] Filed: Aug. 30, 1982

[30] Foreign Application Priority Data

Sep. 16, 1981 [FI] Finland ..... 812885

[51] Int. Cl.[3] ..... B30B 9/24

[52] U.S. Cl. ..... 100/118; 100/122; 100/907; 210/400; 425/362; 44/30

[58] Field of Search ..... 100/122, 123, 124, 153, 100/154, 118, 119, 120, 907; 210/400, 401, 387; 425/363, 371, 373, 383, 362; 44/28, 29, 30

[56] References Cited

U.S. PATENT DOCUMENTS

| | | | |
|---|---|---|---|
| Re. 21,723 | 2/1941 | Thompson | 100/122 X |
| 2,989,932 | 6/1961 | Egee et al. | 425/371 X |
| 3,446,139 | 5/1969 | Coffelt | 100/118 |

*Primary Examiner*—Peter Feldman

*Attorney, Agent, or Firm*—Bucknam and Archer

[57] ABSTRACT

Press for removing water, wherein the material to be treated is led together with a wire which is pervious to water through a press nip zone formed by opposite surfaces. The press comprises compressible means for transporting the material to be treated. This means runs through the press nip and comprises several compression chambers which open out against the wire pervious to water. The compression chambers are preferably made so that they expand towards the water transmitting wire or felt, e.g. like a truncated pyramid.

4 Claims, 6 Drawing Figures

PRESS FOR REMOVING WATER

The present invention relates to a press for removing water wherein the material to be treated is led together with a wire or felt pervious to water through a press nip formed by opposite surfaces, which is particularly intended for removing water from a fibrous substance, such as peat etc.

The pressing of water from peat has turned out to be complicated due to the colloidal substances in peat. When the removal of water is performed in conventional roll or belt presses, the pressing has to be carried out using thin webs in such a manner that the rate of change of the nip pressure is low. In case the rate of change exceeds the critical velocity, no water is removed from the web, and it flows backwards in the press nip so that a web break occurs. Due to this, the capacity of the presses is low.

The object of the present invention is to provide a press in which the flowing backward of the material is prevented. The invention is characterized in that there are compressible means for conveying the material which is to be treated, this means passing through the press nip and comprising several compression chambers and which open out against the wire or felt which are pervious to water.

The dewatering press according to the invention can operate with high speeds and the layer to be treated can be thick. The pressed material is in pellets which are easier to handle than web-like material.

The compression chambers of the compressible means preferably expand towards the water transmitting wire or felt, whereby already a relatively small compression of the compressible means causes efficient removal of water.

The invention is described in more detail in the following with reference to the schematic drawings illustrating some preferred embodiments. In the figures.

Figure 1:
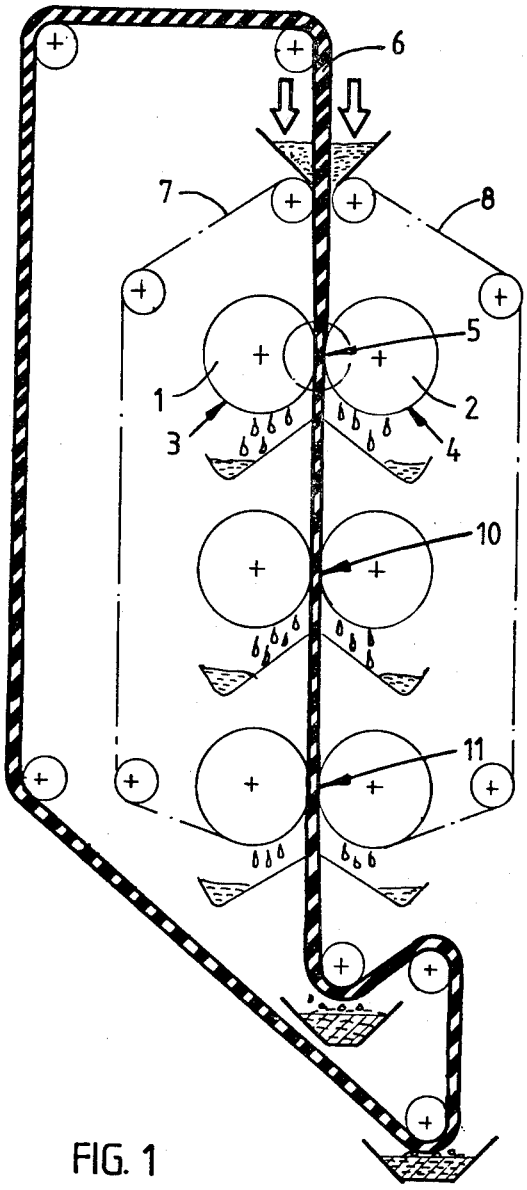
FIG. 1 is a side view of a press section in which dewatering press according to the invention is applied.
Figure 2:
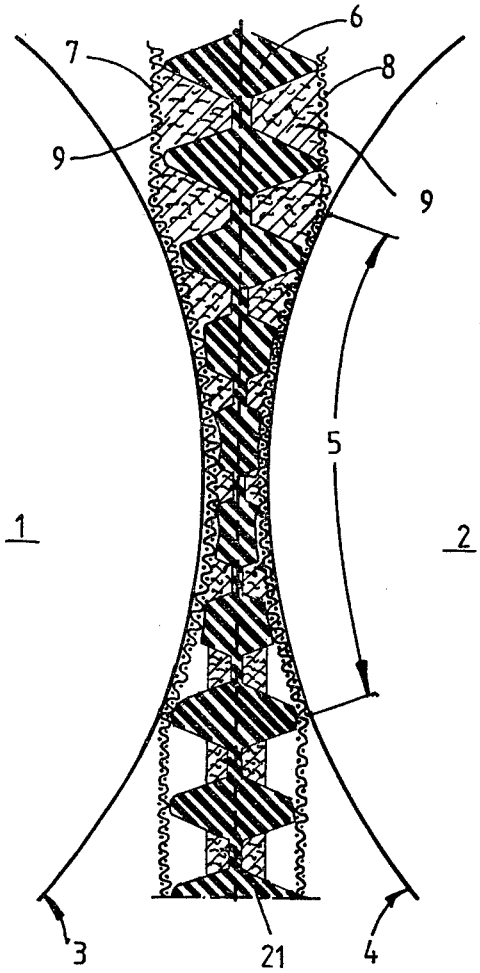
FIG. 2 is an enlarged partial view of the press nip of the press section according to FIG. 1.
Figure 3:
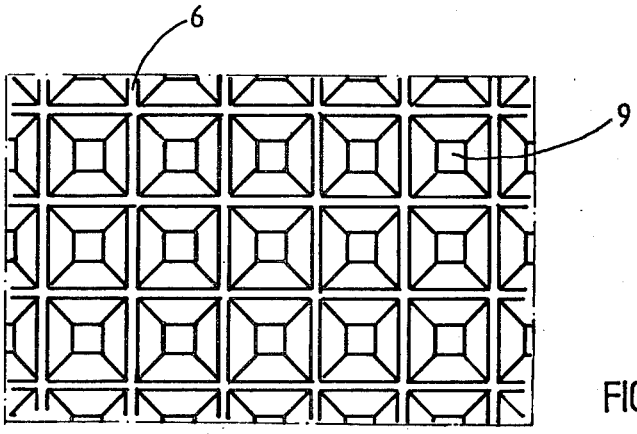
FIG. 3 shows a top view of the means conveying the material to be treated.

In FIGS. 1 to 3, reference numerals 1 and 2 denote the rotating upper and lower roll of the press section, the opposite surfaces 3 and 4 of them form a first press nip 5 through which the material to be treated is conveyed by compressible means 6 together with wires or felts 7 and 8 pervious to water. In both sides of the compressible means there are compression chambers 9 having the form of a truncated pyramid, which are filled before the press section.

When the compression chamber passes the press nip 5, its volume decreases, whereby water is pressed from it, said water being removed through the wires 7 and 8. The water in the wires and between the wire and the roll is removed in a manner known per se. At subsequent, second and third press nips 10 and 11 the material in the compression chambers is subjected to gradually increasing pressure and is contracted more. Eventually new material can be added to the compression chambers after the first press nip so that the compression chambers are filled. After the third press nip the compression chambers are emptied and the material pressed into pellets is transported to a combustion plant.

Figure 4:
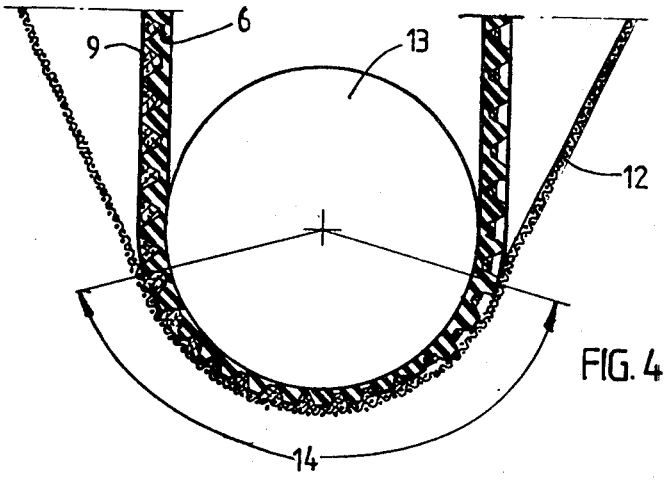
FIG. 4 shows an alternative embodiment.

In FIG. 4 there is shown an alternative embodiment in which the inner surface of a wire 12 and the outer surface of a roll 13 form an extended nip 14 which the means 6 conveying the material is subjected to compression. Compression chambers 9 are disposed only in one side of the means, i.e. the one against the wire.

Figure 5:
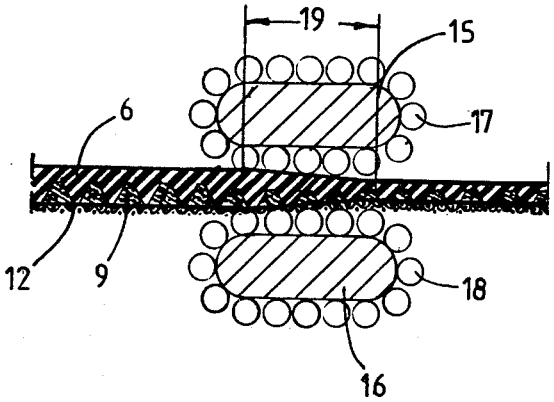
FIG. 5 shows another alternative embodiment.

In the embodiment shown in FIG. 5 the means 6 conveying the material and provided with compression chambers passes through a narrowing press nip 19 formed by rolls 17 and 18 guided by supporting means 15 and 16.

Figure 6:
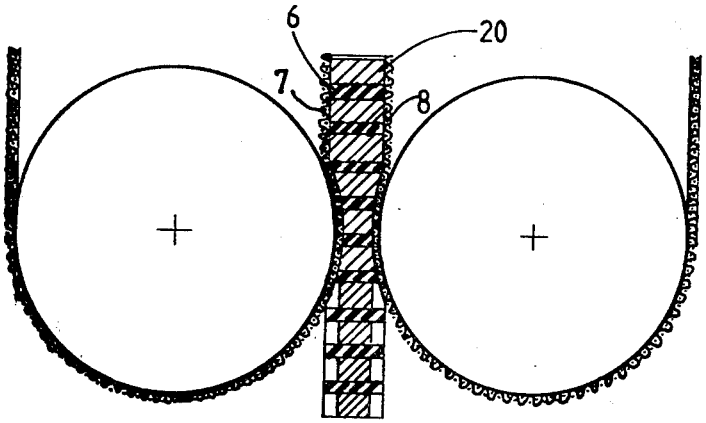
FIG. 6 shows still another embodiment.

The compression chambers can form holes 20 going through the means 6, as shown in FIG. 6.

EXAMPLE

Peat pretreated with polyelectrolyte having a dry matter content of 8% was conveyed to a press section according to FIG. 1. The press section consisted of two press nips formed by 500 mm grooved rolls. The wire pressure of the press nips was 200 and 300 N/cm and the velocity was 4 m/min. The compression chambers were according to FIGS. 2 and 3 and their height was 10 mm, bottom surface 5×5 mm and the opening 15×15 mm. The contraction of the compression chamber was 5 mm. The dry matter content measured after the second press was 34%.

The means 6 provided with polyelectrolyte is preferably made of rubber. In order to limit its longitudinal and cross directional expansion, it is provided with a reinforcement texture which is preferably disposed adjacent the bottom part of the compression chambers, as shown in FIG. 2.

The form of the compression chambers can be that of a cone, a pyramid, an obelisk or a wedge perpendicular to means 6.

We claim:

1. A press for removing water wherein the material to be treated is conveyed together with a wire or felt pervious to water through a press nip formed by opposite surfaces, characterized in that it comprises compressible means for conveying the material to be treated, said means having several compression chambers opening out against the wire or felt pervious to water, said compression chambers being in the form of a truncated pyramid with the long parallel side of the truncated pyramid abutting the wire or felt pervious to water.

2. A press for removing water according to claim 1, characterized in that the compression chamber forms a hole going through the compressible means.

3. A press for removing water according to claim 1 characterized in that the compressible means comprises a reinforcement texture limiting the longitudinal and cross-directional expansion.

4. A press for removing water according to claim 1 wherein said compressible means comprises a series of compressible elements extending across its entire width and impervious to water.

* * * * *